US006971199B2

(12) United States Patent
Kim

(10) Patent No.: US 6,971,199 B2
(45) Date of Patent: Dec. 6, 2005

(54) STRUCTURE FOR SUPPORTING SIGN BOARD

(75) Inventor: Yong Soo Kim, Goyang (KR)

(73) Assignee: Hanyang Frame Co., Ltd., Gyeonggi-Do (KR)

( * ) Notice: Subject to any disclaimer, the term of this patent is extended or adjusted under 35 U.S.C. 154(b) by 1 day.

(21) Appl. No.: 11/002,481

(22) Filed: Dec. 1, 2004

(65) Prior Publication Data

US 2005/0076553 A1 Apr. 14, 2005

Related U.S. Application Data

(62) Division of application No. 10/271,846, filed on Oct. 15, 2002, now Pat. No. 6,880,279.

(30) Foreign Application Priority Data

Oct. 16, 2001 (KR) ..... 2001-31600

(51) Int. Cl.[7] ..... G09G 15/00

(52) U.S. Cl. ..... 40/607.12; 40/607.14; 40/612

(58) Field of Search ..... 40/607.14, 607.01, 40/607.12, 611.12, 612; 248/218.4, 230.4, 248/223.41, 225.11, 231.51, 218.14

(56) References Cited

U.S. PATENT DOCUMENTS

| | | | | |
|---|---|---|---|---|
| 3,453,759 | A | | 7/1969 | Weaver |
| 4,480,403 | A | | 11/1984 | Williams |
| 4,548,377 | A | | 10/1985 | Huel |
| 4,910,901 | A | | 3/1990 | Boyar |
| 5,230,176 | A | | 7/1993 | Schomaker |
| 5,269,394 | A | * | 12/1993 | Haroldson, Sr. ..... 182/113 |
| 5,335,889 | A | | 8/1994 | Hopkins et al. |
| 5,463,973 | A | | 11/1995 | Tait |
| 5,634,619 | A | | 6/1997 | Alessi |
| 5,903,991 | A | | 5/1999 | Sasse |
| 6,233,858 | B1 | | 5/2001 | Brach, Jr. et al. |
| 6,293,035 | B1 | | 9/2001 | LaPointe |
| 6,601,328 | B1 | | 8/2003 | Banaquista et al. |
| 2003/0213152 | A1 | | 11/2003 | Kim |
| 2003/0213153 | A1 | | 11/2003 | Kim |

FOREIGN PATENT DOCUMENTS

| | | |
|---|---|---|
| GB | 2126271 A | 3/1984 |
| WO | WO 86/00453 | 1/1986 |

OTHER PUBLICATIONS

U.S. Appl. No. 11/015,215, filed Dec. 2004, Kim.

* cited by examiner

*Primary Examiner*—Cassandra Davis
(74) *Attorney, Agent, or Firm*—Sheridan Ross P.C.

(57) ABSTRACT

A structure for supporting a sign board is disclosed. The structure includes: a post clamp having a pair of arched clamping bands which are hingedly coupled and joined to each other by a fastening element, at least one clamping band having a pillar; a hanger having a socket pipe joined to the pillar of the post clamp, a support bar inserted into the socket pipe and joined by a fastening element, the support bar having an axial coupling groove; at least one connector having a first coupling plate with a coupling bulge adapted to be fitted into the coupling groove of the support bar and with a first arched hinge holder, and a second coupling plate coupled to the first coupling plate having a second arched hinge holder; and a sign board having a coupling bulge and a guide slot through which the hinge holders of the connector pass.

16 Claims, 13 Drawing Sheets

- PRIOR ART -

- PRIOR ART -

STRUCTURE FOR SUPPORTING SIGN BOARD

This application is a Divisional of U.S. patent application Ser. No. 10/271,846, filed Oct. 15, 2002, Now U.S. Pat. No. 6,880,279 which claims the benefit of Korean Utility Model Application No. 2001-0031600, which was filed in the Korean Intellectual Property Office, Republic of Korea, on Oct. 6, 2001.

BACKGROUND OF THE INVENTION

1. Field of the Invention

The present invention relates to a sign board installed on a roadside to exhibit information regarding roads, buildings or street names for convenience of drivers or pedestrians, and more particularly to a structure for supporting a sign board showing driving or walking information, which allows the sign board to be easily and stably attached to a post and which provides an acceptable appearance of the sign board and the post.

2. Description of the Prior Art

In general, various road guide signs, which are intended to show drivers and pedestrians information relating to dangerous circumstances of a road to assure safety and smooth driving conditions, and which are further intended to provide drivers and pedestrians with information relating to a road, such as progressing direction of a road, a distance to a destination, and a destination point, are installed on roadsides, for the drivers' and pedestrians' convenience.

Such a sign board is arbitrarily manufactured into a proper shape and size and installed on a post at a roadside to allow drivers and pedestrians to distinctly recognize its communicative information.

Accordingly, a conventional sign board is hung on a cantilever beam fixed to an upper part of a post having a proper height, which is shown in FIGS. 1 and 2.

As shown in FIGS. 1 and 2, a cantilever hanger 1 is coupled to a post "P". To this end, the cantilever hanger 1 is provided at its end with a band clamp 2, which is comprised of a pair of semicircular clamping bands 2*a* and 2*b*, each clamping band having a pair of flanges at both its ends. The pair of clamping bands 2*a* and 2*b* are placed on an outer surface of the post "P" such that the pair of clamping bands 2*a* and 2*b* face each other. Thereafter, the facing flanges of the clamping bands 2*a* and 2*b* are fastened by bolts 3, so that the cantilever hanger 1 is horizontally supported on the post "P".

Subsequently, a pair of hinge brackets 6, each of which is formed into a fork shape in its cross section, are coupled to both sides of an upper end of a sign board 5 by bolts 7. The hinge brackets 6 are rotatably connected to two pairs of lugs 4 spacedly provided at a lower portion of the cantilever hanger 1, by hinge bolts 8 and hinge nuts 8*a*. Each of the hinge bolts 8 is provided at its end with a split pin 9 to prevent loosening of the hinge nut 8*a*.

However, since the conventional structure for supporting a sign board has the band clamp 2 comprised of a pair of clamping bands 2*a* and 2*b*, which are completely separated from each other, the band clamp 2 must be fastened by the bolts 3 at both its ends. Furthermore, since the hinge brackets 6 of the sign board 5 must be connected to the lugs 4 of the cantilever hanger 1 by the hinge bolts 8 and the hinge nuts 8*a*, respectively, an operation of coupling the sign board 5 on the post "P" is considerably complicated.

The sign board 5 may be coupled to a post for a street light or a telephone pole other than the dedicated post according to its installation site. However, since the conventional band clamp 2 is designed to have a certain diameter, the band clamp 2 cannot appropriately cope with changes of the diameter of the post "P". Accordingly, various types of band clamp 2 must be prepared to have different diameters in consideration of diameters of the post "P" on which the sign band 5 is to be installed. This is unfavorable in terms of productivity, compatibility and production cost.

In addition, since the band clamp 2 can accommodate only one sign board 5, where a plurality of sign boards 5 are installed on one post "P", a number of band clamps 2 corresponding to the number of the sign boards 5 must be prepared. In this case, the installation operation of the sign boards is considerably complicated, and production cost is increased and a cityscape is significantly deteriorated.

Furthermore, since the sign board 5 is partially interrupted by the hinge brackets 6, the functional area of the sign board 5 is reduced, thereby reducing its effectiveness.

Though the respective components are manufactured by iron material and then coated with paint, the components are apt to be oxidized and corroded due to paint damage at their coupled portions after a long time period, thereby causing contamination of the post "P" and reduction of service life of the post "P".

SUMMARY OF THE INVENTION

Accordingly, the present invention has been made keeping in mind the above problems occurring in the prior art, and an object of the present invention is to provide a structure for supporting a sign board, which allows the sign board to be easily and stably installed on a post, regardless of a size and a shape of the post.

Another object of the present invention is to provide a structure for supporting a sign board, which allows one or more sign boards to be installed on a post by means of one band clamp if necessary.

A further object of the present invention is to provide a structure for supporting a sign board, which maximizes a functional area of the sign board to improve effectiveness of the sign board.

A further object of the present invention is to provide a structure for supporting a sign board, which enables efficient suppression of oxidization and corrosion of associated components without additional painting procedure so as to permanently maintain its favorable appearance and to extend its service life remarkably.

In order to accomplish the above object, the present invention provides a structure for supporting a sign board, comprising: a post clamp including at least two arched clamping bands, which are hingedly coupled to each other at their adjacent ends and joined to each other by a fastening element at their free ends, at least one of the clamping bands being provided at its outer surface with a pillar protruded therefrom; a hanger including a socket pipe perpendicularly joined to the pillar of the post clamp, and a support bar inserted into the socket pipe and joined thereto by a fastening element, the support bar being axially provided at its lower side with a coupling groove; at least one connector including a first coupling plate, which is provided at its upper side with a coupling bulge adapted to be fitted into the coupling groove of the support bar and is provided at its lower side with a first arched hinge holder, and a second coupling plate which is coupled to the first coupling plate and is provided at its lower side with a second arched hinge holder; and the sign board which is provided at its upper side with a coupling bulge and is provided adjacent to the coupling bulge with a guide slot through which the hinge holders of the connector pass.

According to an aspect of the present invention, the post clamp may further include at least one auxiliary clamping band coupled between the first and second clamping bands, which is provided at its opposite ends with a hinge groove and a hinge bulge corresponding to each other, whereby the auxiliary clamping band is selectively coupled between the first and second clamping bands according to a size of the post.

According to another aspect of the present invention, the post clamp, the hanger and the connector may be made of nonferrous metal excellent in corrosion resistance, such as aluminum.

By the structure according to the present invention, a sign board is easily installed on a post by a simple operation of placing a post clamp on the post and joining the free ends of the post clamp to each other by bolts and nuts. In addition, since associated components of the structure are manufactured from nonferrous metal excellent in corrosion resistance, it is possible to prevent rusting and corrosion of the components, ensure favorable appearance of the structure, and extend a service life of the structure.

Furthermore, since the structure can selectively adopt auxiliary clamping bands according to a diameter of a post, a sign board can be easily installed on the post. Since one post clamp can accommodate a plurality of sign boards if necessary, an installation cost can be reduced.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

Figure 1:
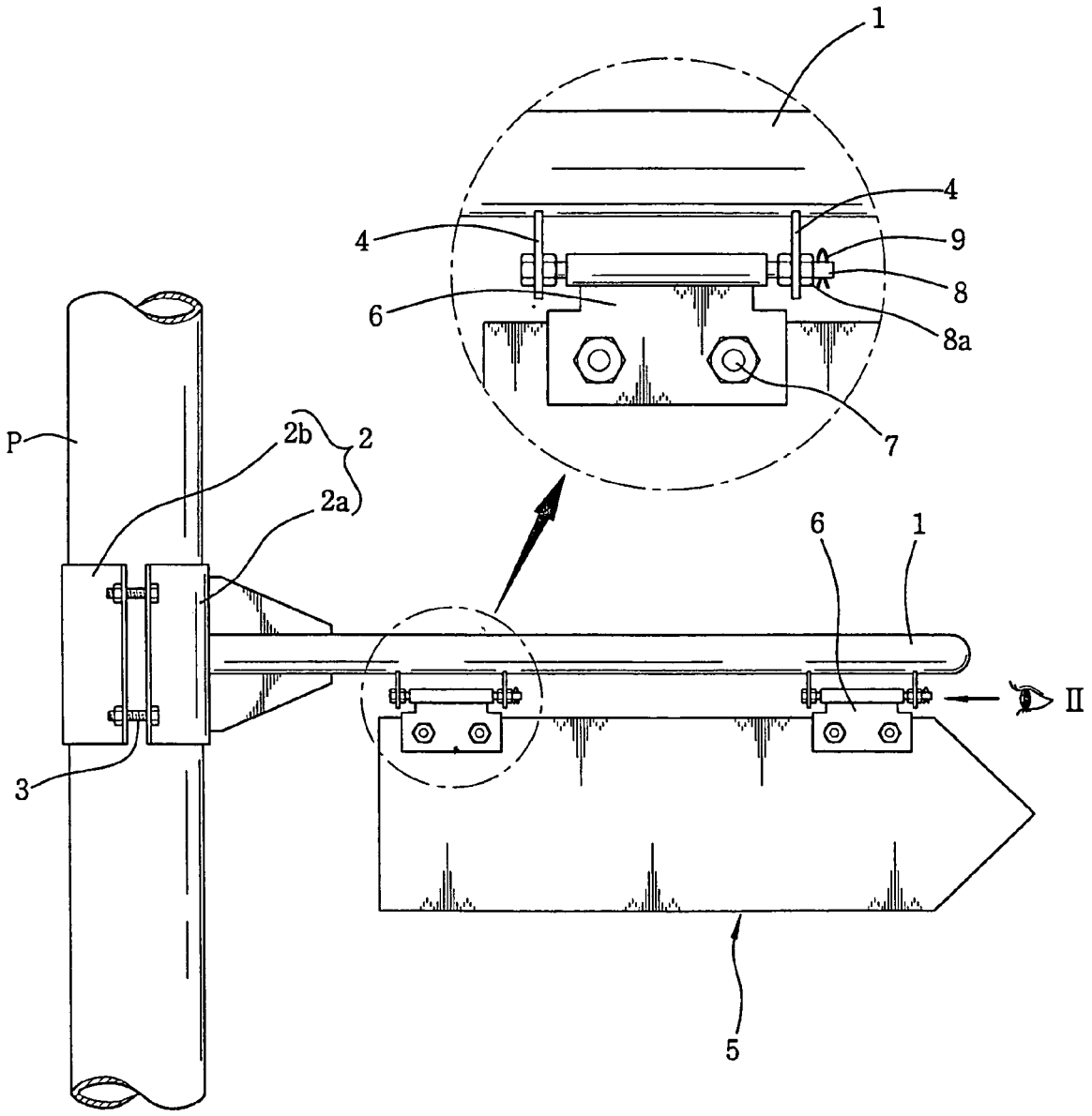
FIG. 1 is a front elevation view of a conventional structure for supporting a sign board, which is partially enlarged.
Figure 2:
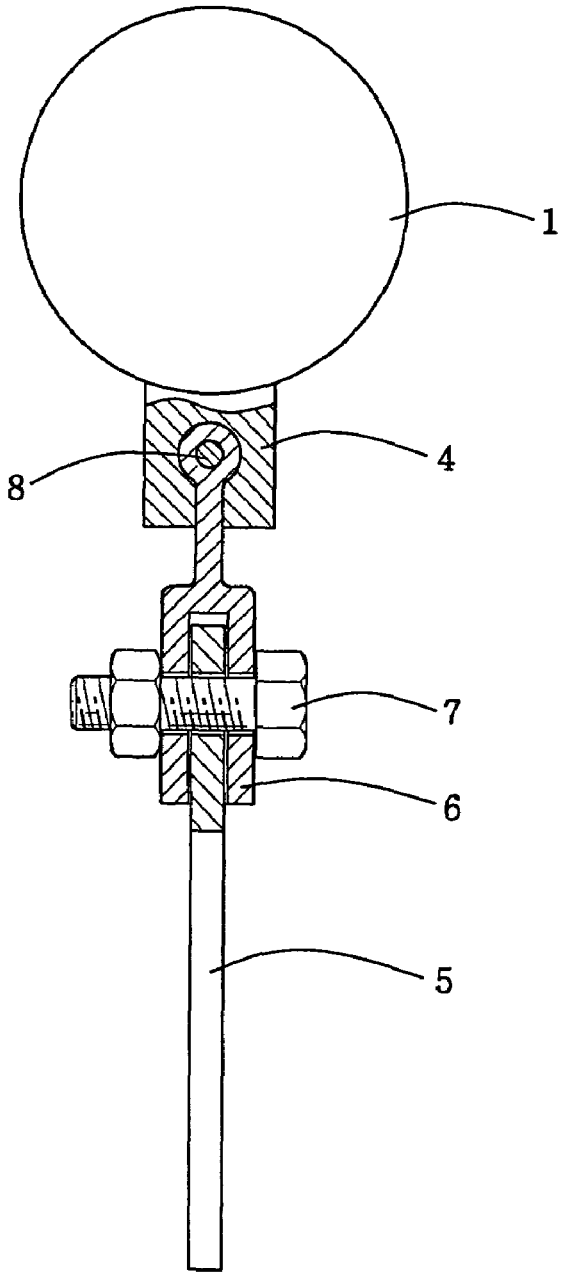
FIG. 2 is a side elevation view taken along line II of FIG. 1, which is partially broken away.
Figure 3:
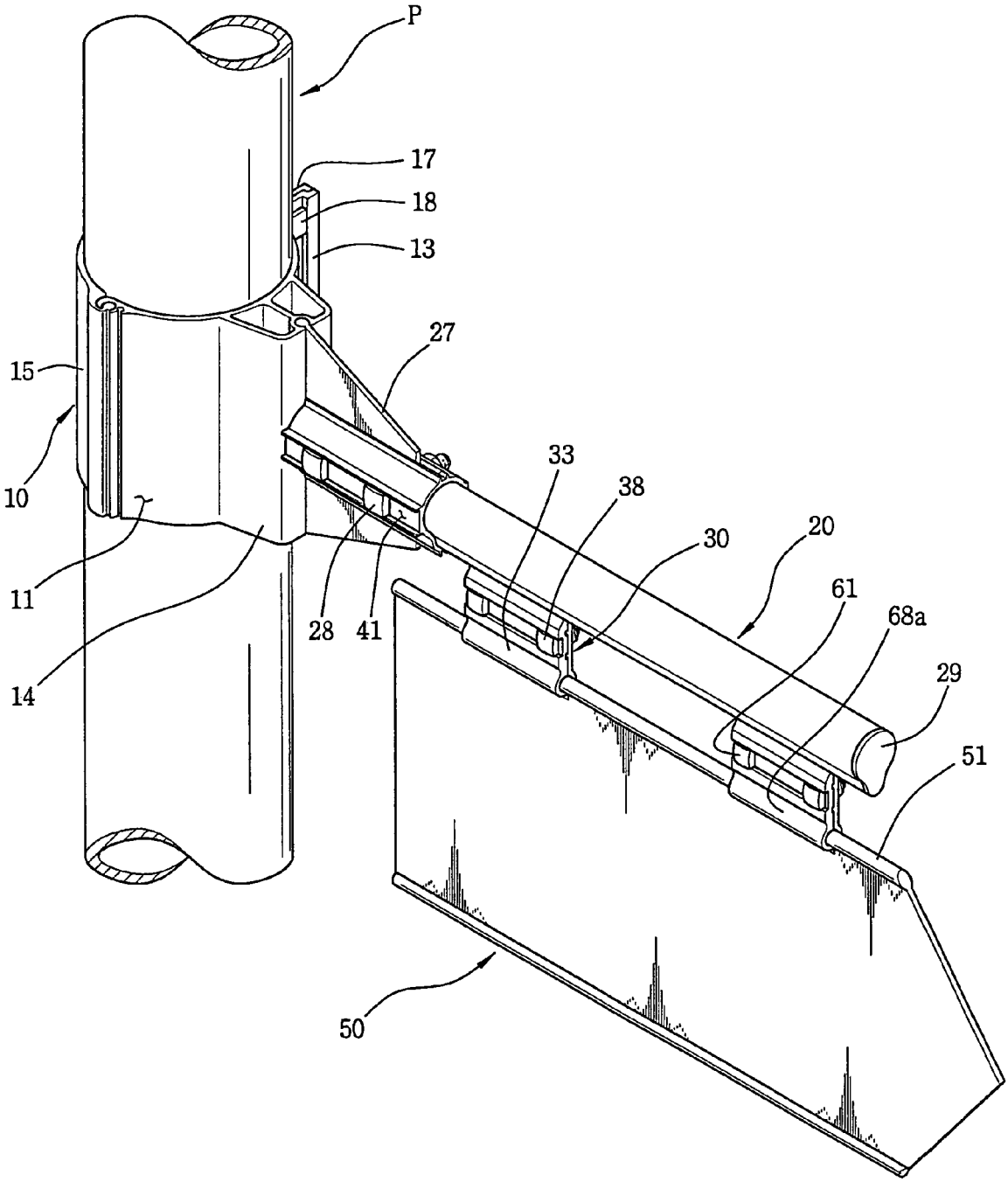
FIG. 3 is a perspective view of a structure according to the present invention, by which a sign board is installed on a post.
Figure 4:
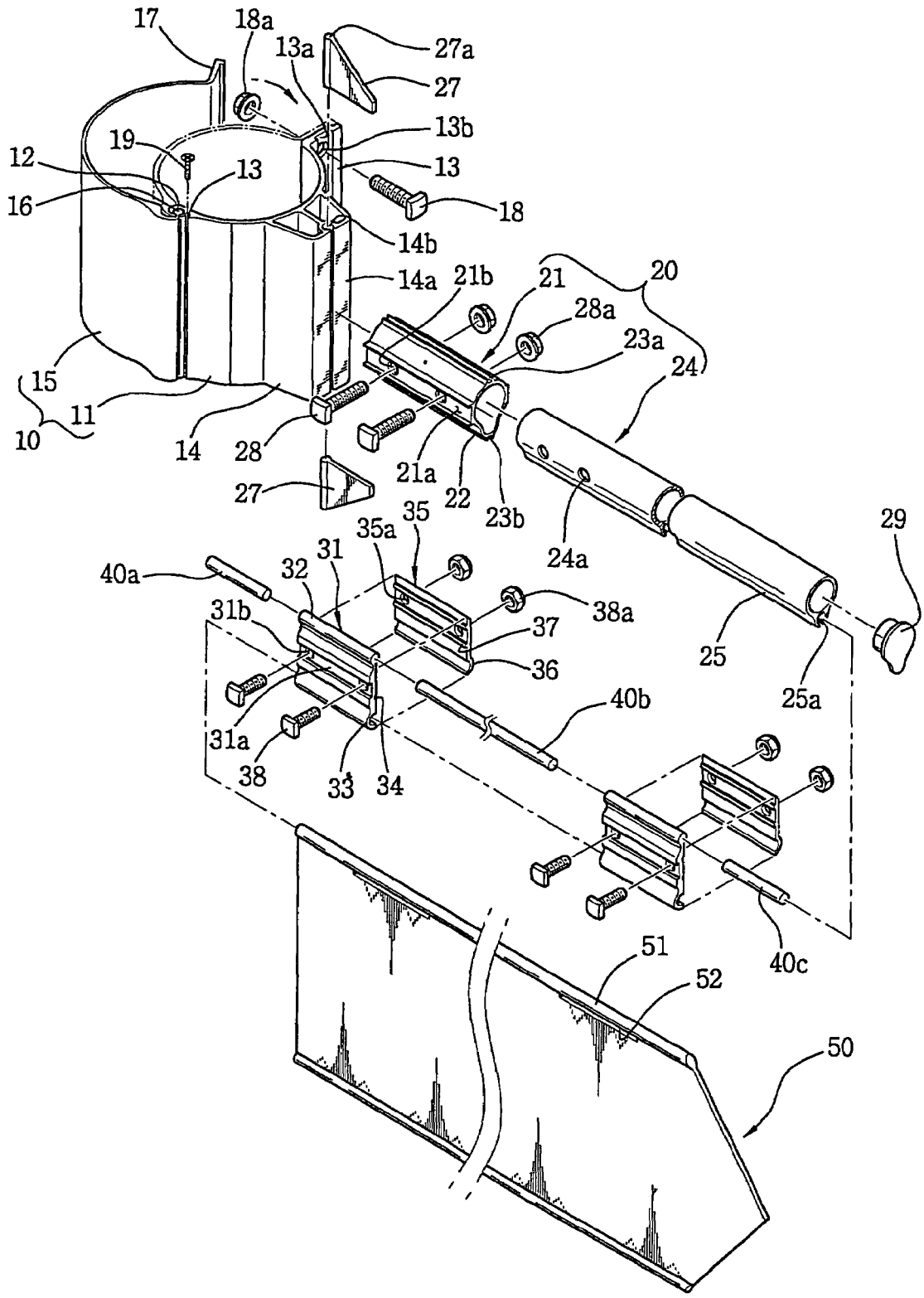
FIG. 4 is an exploded perspective view of the structure for supporting a sign board according to the present invention.
Figure 5:
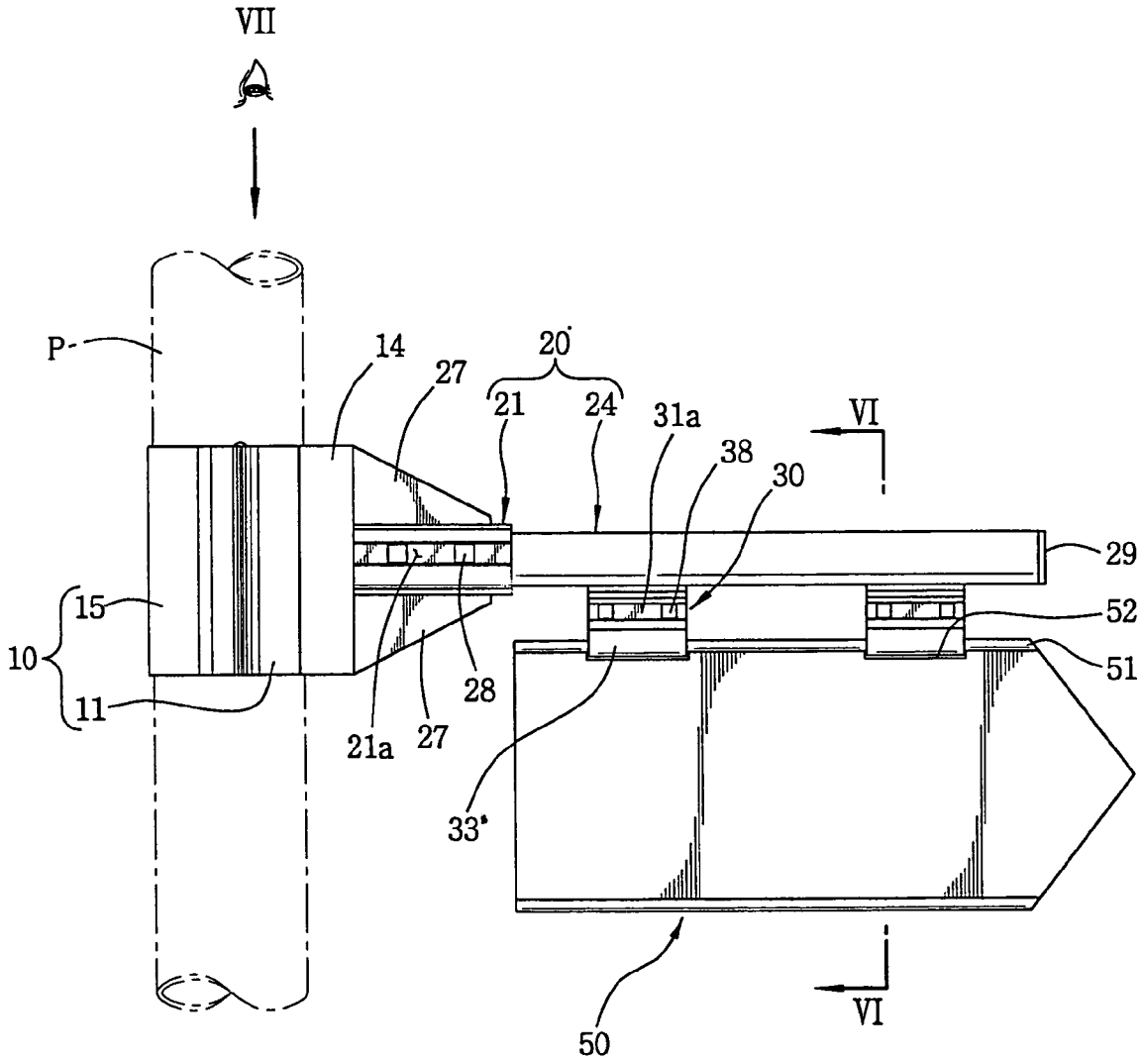
FIG. 5 is a front elevation view of the structure in FIG. 4.
Figure 6:
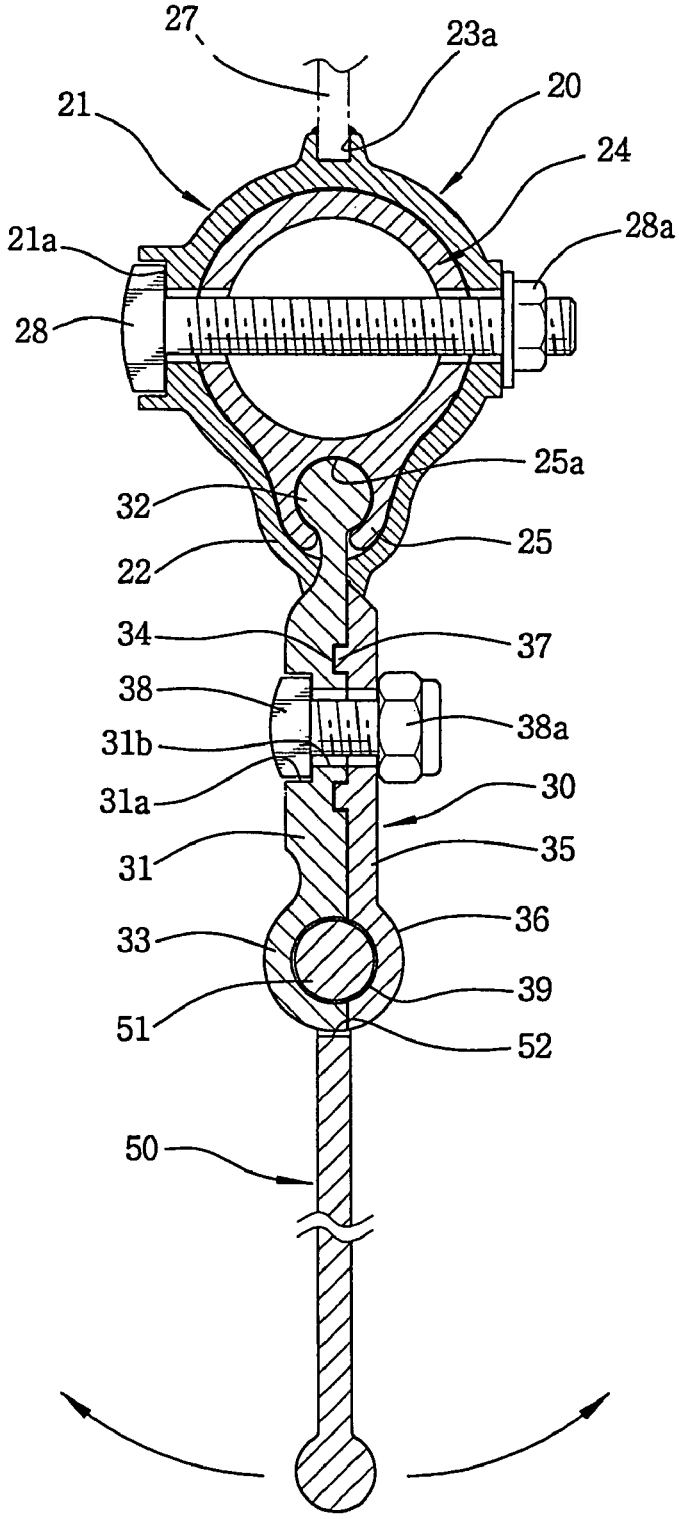
FIG. 6 is a cross-sectional view taken along line VI—VI of FIG. 5.

This invention will be described in further detail by way of example with reference to the accompanying drawings.

As shown in FIGS. 3 to 6, a structure for supporting a sign board according to the present invention includes a post clamp 10 mounted on a post "P" installed on a roadside, a hanger 20 radially coupled to the post clamp 10 to be horizontally positioned, and connectors 30 for connecting a sign board exhibiting traffic information to the hanger 20.

The post clamp 10 includes a pair of semicircular clamping bands 11 and 15, which are hingedly coupled to each other at their ends and fastened by bolts 18 and nuts 18*a* at their other ends.

Figure 7:
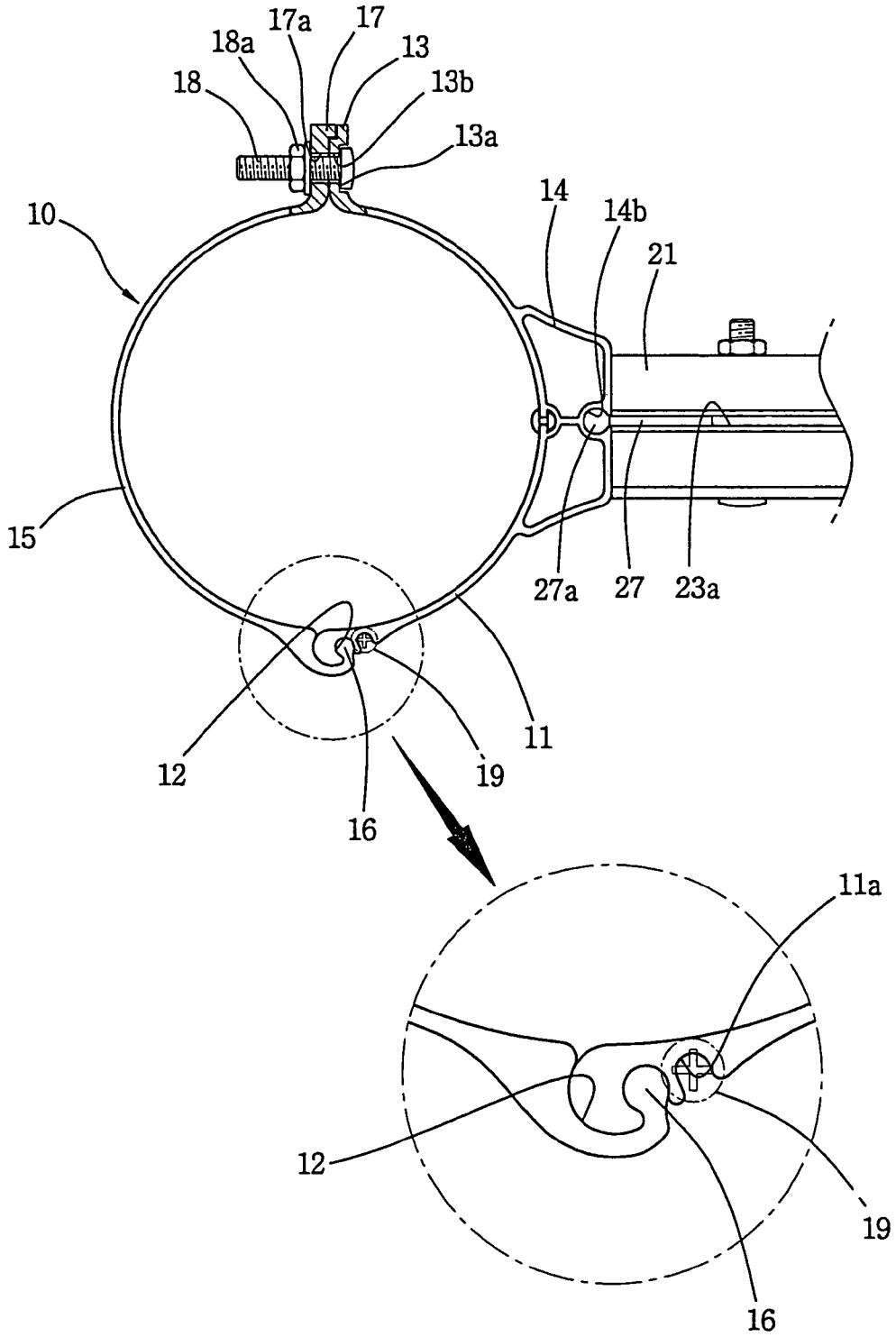
FIG. 7 is a cross-sectional view taken along line VII of FIG. 5.

As shown in FIG. 7, the first clamping band 11 is provided at its end with a hinge groove 12 having a C-shaped cross section. The first clamping band 11 is further provided adjacent to the hinge groove 12 with a screw groove 11*a* having a C-shaped cross section, so that the screw groove 11*a* is engaged with retaining screws 19 at both ends to prevent separation of the second clamping band 15. More specifically, since the retaining screws 19 are partially embedded in the hinge groove 12 at their head portions, a hinge bulge 16 of the second clamping band 15 cannot be separated from the hinge groove 12.

The first clamping band 11 is provided at the other end with a flange 13 having a plurality of joint holes 13*b*. The flange of the first clamping band 11 is provided at its outer surface with a channel-shaped bolt head seat 13*a* to prevent rotation of bolts inserted through the joint holes 13*b*.

The first clamping band 11 is provided at the center of its outer surface with a pillar 14 to connect the hanger 20 thereto and to support the hanger 20. The center of a coupling face 14*a* of the pillar 14 is longitudinally provided with a coupling groove 14*b* having a C-shaped cross section to receive reinforced ribs 27 (described hereinafter) thereinto.

The second clamping band 15 is provided at its end with the hinge bulge 16, which is fitted into the hinge groove 12 of the first clamping band 11, and is provided at the other end with a flange 17 having a plurality of joint holes 17*a*.

The post clamp 10 is preferably manufactured from nonferrous metal excellent in corrosion resistance, such as aluminum material, by an extrusion process.

The hanger 20 includes a socket pipe 21 joined to the pillar 14 of the post clamp 10 by welding, and a support bar 24 slidably inserted into the socket pipe 21 and coupled thereto by bolts 28 and nuts 28*a*. The socket pipe 21 is provided at its inner surface with a key channel 22 and the support bar 24 is provided at its outer surface with a key ridge 25 corresponding to the key channel 22, so that a position of the support bar 24 relative to the key channel 22 is established and a relative rotation between the key channel 22 and the key ridge 15 is prevented.

The socket pipe 21 is axially provided at its outer surface with a bolt head seat 21*a* so as to prevent bolt heads seated in the bolt head seat 21*a* from being rotated. The bolt head seat 21*a* includes two spaced joint holes 21*b*, so that bolts 28 are radially inserted into the joint holes 21*b*.

Preferably, the reinforced ribs 27 are coupled to the upper and lower sides of the socket pipe 21 so as to more stably support the socket pipe 21 to the pillar 14 of the post clamp 10.

Each of the reinforced rib 27 is provided with an enlarged coupling bulge 27*a*, which is fitted into a coupling groove 14*b* formed on the pillar 14. The upper and lower reinforced ribs 27 are engaged with upper and lower support grooves 23*a* and 23*b*, which are axially formed on upper and lower surfaces of the socket pipe 21, and then fixed thereto by welding.

The support bar 24 is sized to be relatively long comparing with the socket pipe 21, and is provided with two spaced joint holes 24*a* corresponding to the joint holes 21*b* of the socket pipe 21.

The key ridge 25 of the support bar 24 is provided therealong with a coupling groove 25*a* having a C-shaped cross section. The support bar 24 is provided at its end with an end cap 29.

Like the post clamp 10, the hanger 20 is preferably manufactured from nonferrous metal excellent in corrosion resistance, such as aluminum material, by an extrusion process.

Each of the connectors 30 is comprised of first and second coupling plates 31 and 35, which are joined to each other by bolts 38 and nuts 38*a*.

The first coupling plate 31 is provided at its upper end with a coupling bulge 32, which is fitted into the coupling groove 25*a* of the support bar 24, and is provided at its lower end with a first arched hinge holder 33, which is adapted to hold a coupling bulge 51 of the sign board 50. The first coupling plate 31 is longitudinally provided at its outer surface with a bolt head seat 31*a* so as to prevent bolts fitted therethrough from being rotated. The bolt head seat 31*a* includes two spaced joint holes 31*b*.

The second coupling plate 35 is sized to be shorter than the first coupling plate 31, and is provided at its end with only a second arched hinge holder 36, which constitutes a hinge hole 39 in combination with the first hinge holder 33, so that the coupling bulge 51 of the sign board 50 is rotatably held in the hinge hole 39. The second coupling plate 35 also includes joint holes 35*a* through which the bolts 38 pass.

Preferably, the first coupling plate 31 is provided with positioning grooves 34 and the second coupling plate 35 is provided with positioning protrusions 37 corresponding to the positioning grooves 34, so as to establish a correct relative positioning between both the coupling plates 31 and 35.

The connectors 30, for example two connectors 30, are spacedly positioned at the support bar 24 of the hanger 20. In this case, the two connectors 30 are positioned at predetermined locations on the support bar 24 by rod-shaped spacers 40*a*, 40*b* and 40*c*, which are fitted into the coupling groove 25*a* of the support bar 24 to be positioned outside and between the first and second coupling plates 31 and 35.

Though not shown in the drawings, the positioning of the connectors 30 may be accomplished by stoppers provided at the support bar.

The sign board 50 is provided at its upper and lower sides with coupling bulges 51. The upper side of the sign board 50 includes two spaced guide slots 52 adjacent to the upper coupling bulge 51, through which the hinge holders 33 and 36 of the two connectors 30 pass.

An operation of installing the sign board to the post by the structure according to the present invention will now be described.

First, the socket pipe 21 of the hanger 20 is joined to the pillar 14 of the post clamp 10 by welding. The first hinge holders 33 of the first coupling plates 31 of the connectors 30 are inserted into the guide slots 52 of the sign board 50. Thereafter, the second coupling plates 35 are positioned to face the first coupling plates 31, and the first and second coupling plates 31 and 35 are coupled to each other by the bolts 38 and the nuts 38*a*.

At this point, the first and second coupling plates 31 and 35 of the connectors 30 are accurately coupled to each other by the positioning grooves 34 and the positioning protrusions 37 provided at the facing surfaces of the first and second coupling plates 31 and 35. Consequently, the coupling bulge 51 provided at the upper side of the sign board 50 is rotatably fitted in the hinge hole 39 defined between the first and second hinge holders 33 and 36 of the connectors 30.

Subsequently, the post clamp 10, the support bar 24 of the hanger 20, and the sign board 50 are transported to a construction site, and then installed on the post "P".

In the installation on the post "P", the first clamping band 11, to which the socket pipe 21 is joined, is placed on a proper position of the post "P", and the second clamping band 15 is rotated toward the first clamping band 11, so that the flanges 13 and 17 of the first and second clamping bands 11 and 15 come into contact with each other. Thereafter, the bolts 18 are inserted into the joint holes 13*b* and 17*a* of the flanges 13 and 17, and then engaged with the nuts 18*a*, whereby the post clamp 10 is easily mounted on the post "P".

Thereafter, the support bar 24 of the hanger 20 is inserted into the socket pipe 21 joined to the post clamp 10, and then joined thereto by the bolts 28 and the nuts 28*a*. At this point, the support bar 24 is accurately joined to the socket pipe 21 by engagement of the key channel 22 of the socket pipe 21 and the key ridge 25 of the support bar 14.

In the above operation, since the flanges 13 of the post clamp 10 and the socket pipe 21 are provided at their outer surfaces with the bolt head seats 13*a* and 21*a*, respectively, in order to prevent rotation of the bolts 18 and 28 passed therethrough, the post clamp 10 and the support bar 24 of the hanger 20 can be easily joined to each other by rotating the nuts 18*a* and 28*a*.

After assembly of the support bar 24, the spacers 40*a*, the coupling bulge 32 of the connector 30, the spacer 40*b*, the coupling bulge 32 of the other connector 30, and the spacer 40*c* are sequentially fitted into the coupling groove 25*a* of the support bar 24 in this order, and the end cap 29 is fitted into the end of the support bar 24. By the operation described above, the installation operation of the sign board is completed.

According to the present invention, since the associated components of the present invention, which are installed on the post "P", are manufactured from nonferrous metal excellent in corrosion resistance, such as aluminum material, rusting and corrosion of the components are prevented. Consequently, a favorable appearance of the structure according to the present invention is maintained for a long time, and the service life of the structure is remarkably extended.

Figure 8:
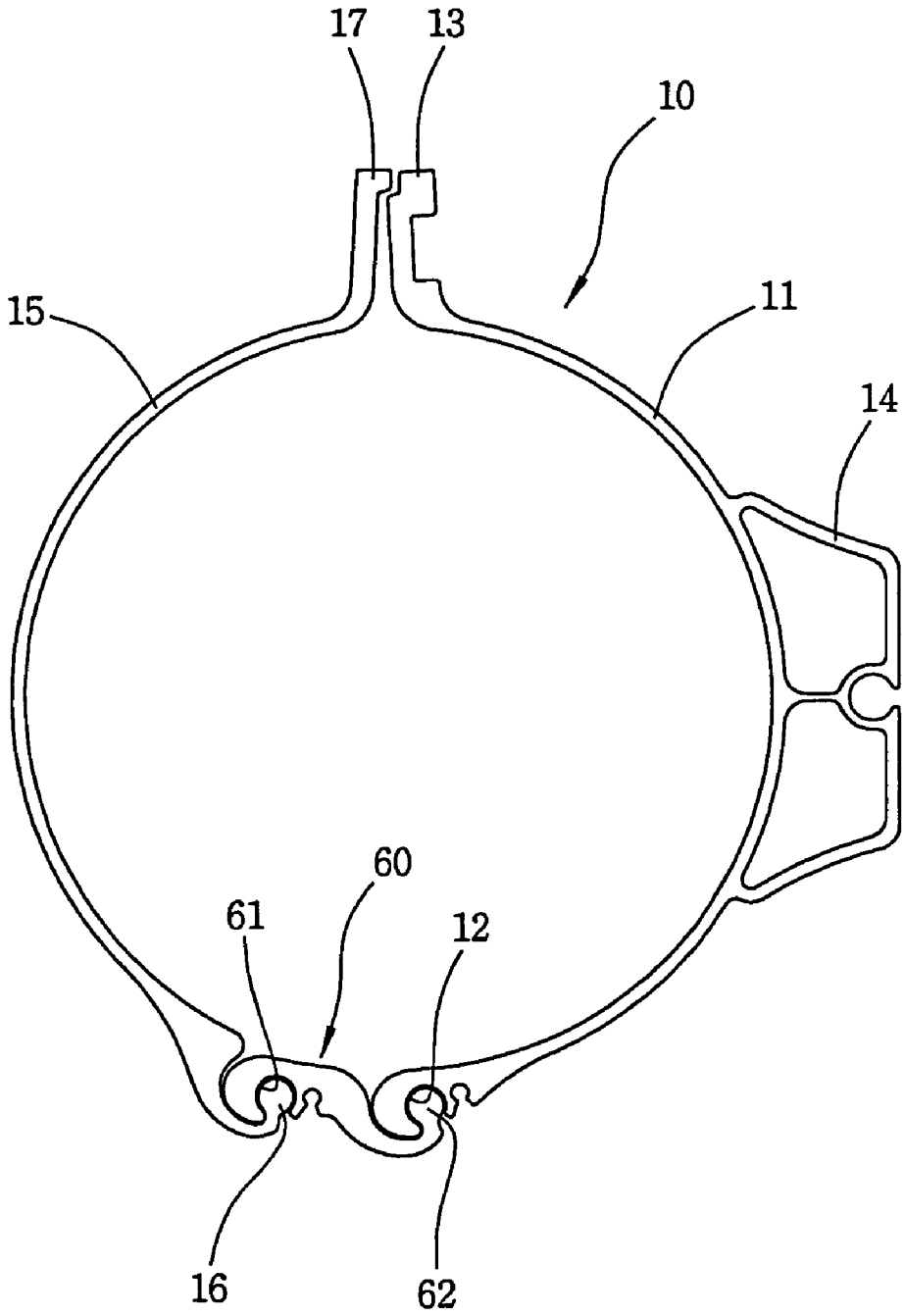
FIG. 8 is a plan cross-sectional view showing another embodiment of a post clamp of the structure for supporting a sign board according to the present invention.

FIG. 8 shows another embodiment of a post clamp according to the present invention. This post clamp is different from the previous embodiment in that the post clamp according to this embodiment further includes an auxiliary clamping band 60, which is positioned between the first and second clamping bands 11 and 15 and is provided at its opposite ends with a hinge groove 61 and a hinge bulge 62, which correspond to the hinge bulge 16 and the hinge groove 12.

According to this embodiment, since the first and second clamping bands 11 and 15 may be coupled to each other with the auxiliary clamping band 60 interposed therebetween in response to a diameter of the post "P", the post clamp 10 can be easily installed on various posts "P", regardless of a diameter of the post.

Figure 9:
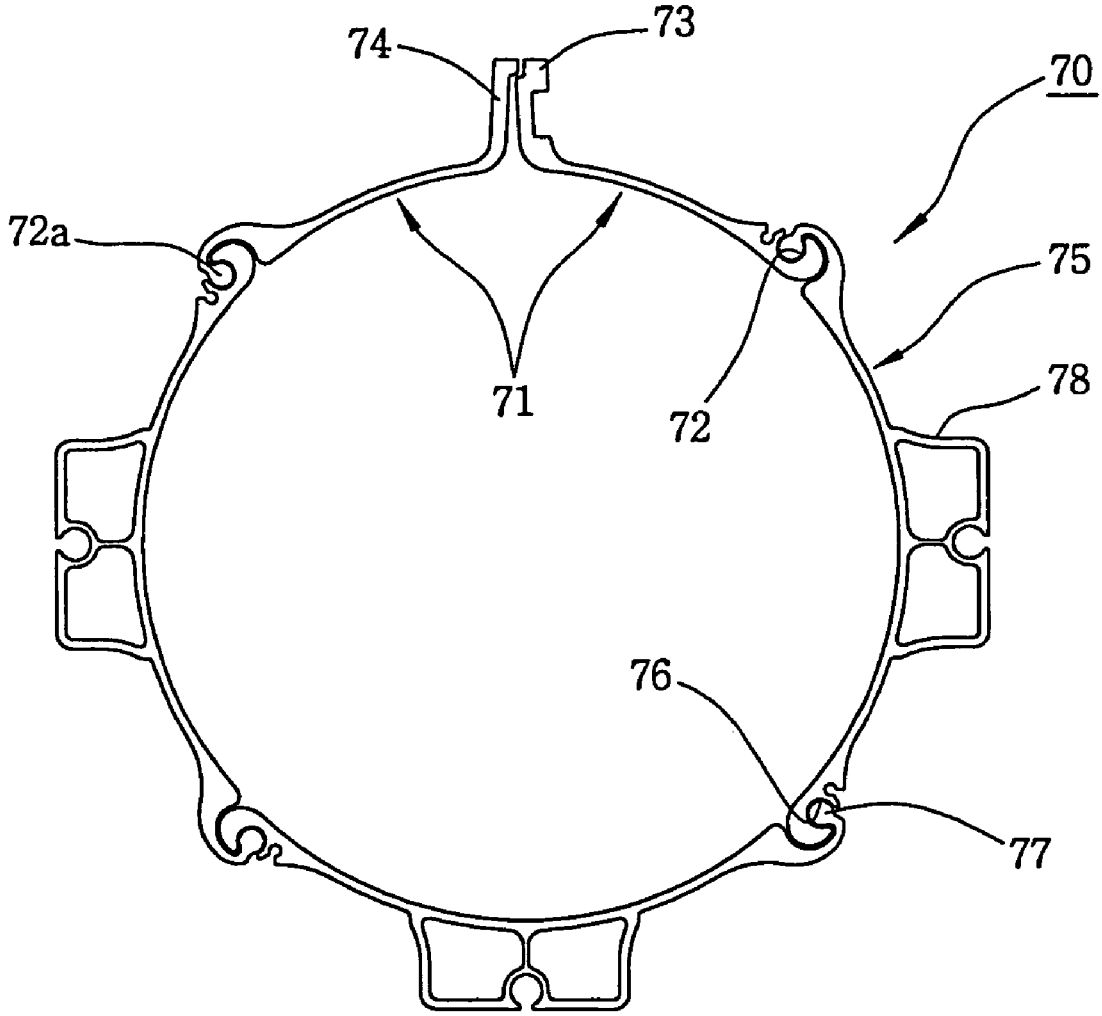
FIGS. 9 and 10 are a plan cross-sectional views showing further embodiments of a post clamp of the structure according to the present invention.

FIG. 9 shows a further embodiment of a post clamp according to the present invention. The post clamp 70 according to this embodiment includes a pair of third clamping bands 71, one of which is provided at its one end with a hinge groove 72 and is provided at its other end with a flange 73, and the other of which is provided at its one end with a hinge bulge 72*a* and is provided at its other end with a flange 74, and a plurality of fourth arched clamping bands 75, each of which is provided at its opposite ends with a hinge groove 76 and a hinge bulge 77 so that the clamping band 75 is hingedly coupled to the third clamping band 71 or the adjacent clamping band 75, and each of which is provided at its outer surface with a pillar 78.

According to this embodiment, since a plurality of sign boards 50 can be easily installed on only one post clamp 70 concurrently, the structure can have a simple appearance, and the number of required post clamps 70 can be reduced.

Figure 10:
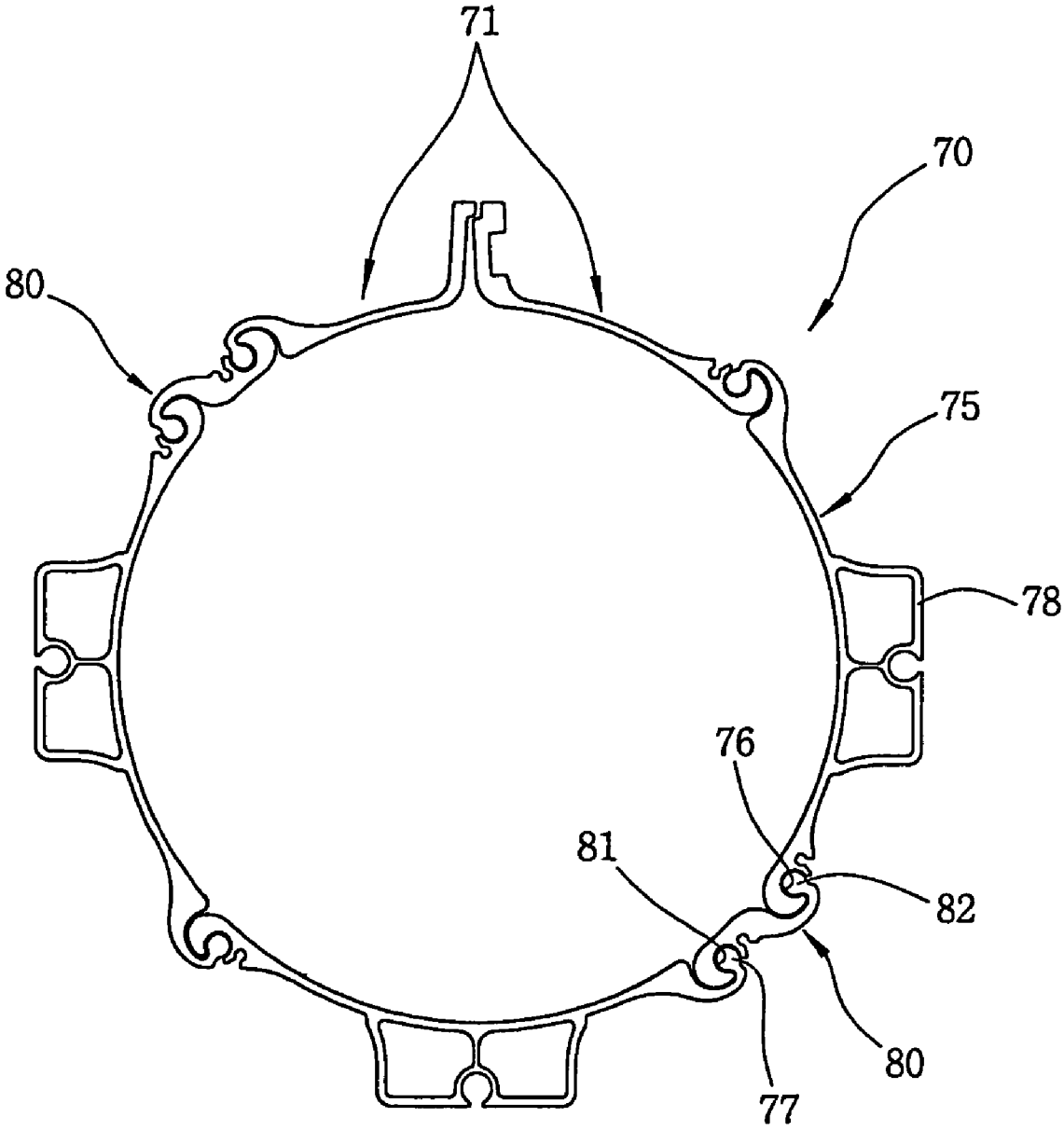

Like the previous embodiment, the post clamp 70 may further include auxiliary clamping bands 80, each of which is provided at its opposite ends with a hinge groove 81 and a hinge bulge 82, and has a proper width, as shown in FIG. 10. In this case, the sign board 50 can be conveniently installed on the post "P", regardless of a diameter of the post "P".

Figure 11:
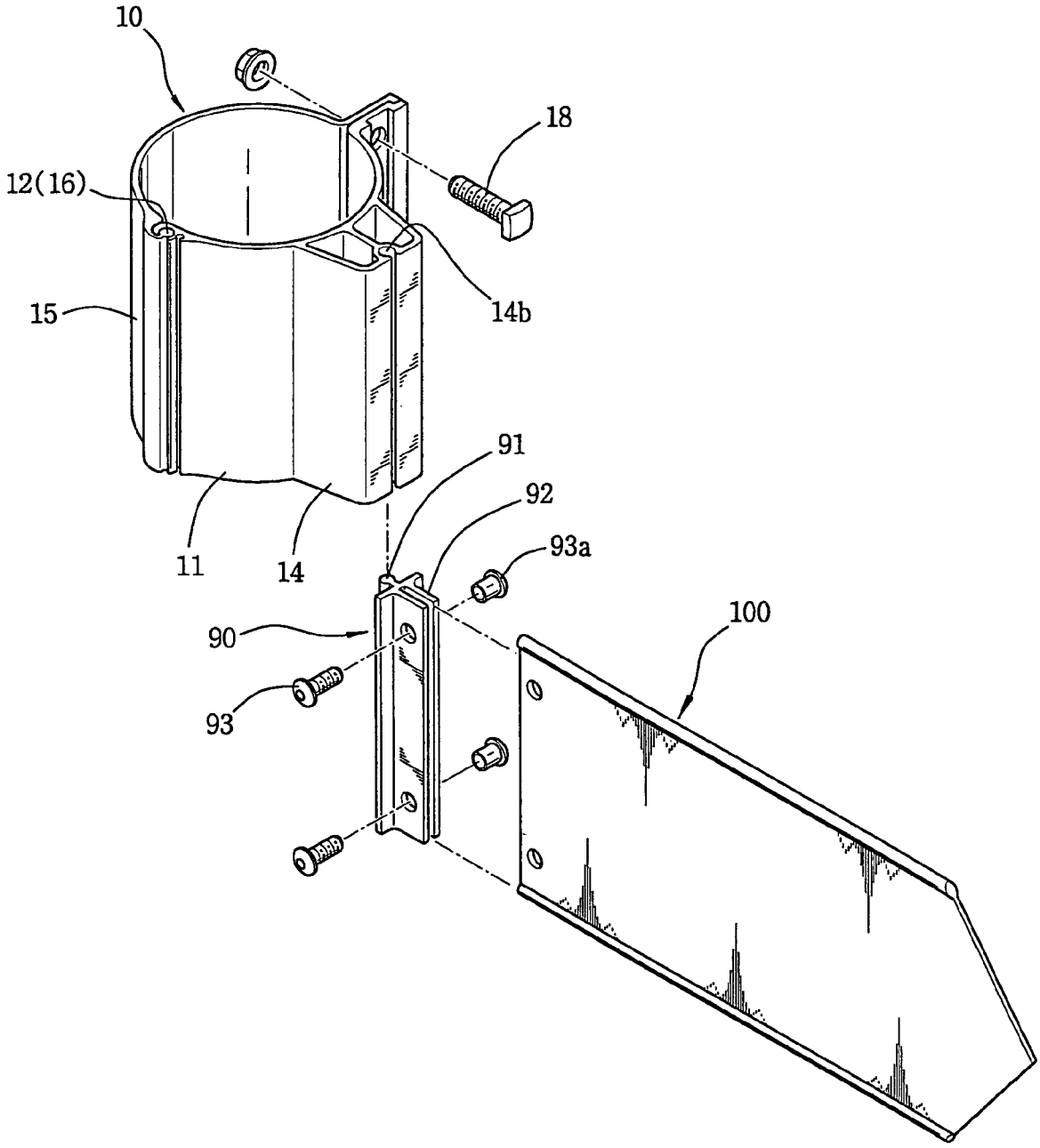
FIG. 11 is an exploded perspective view of a structure for supporting a sign board according to another embodiment of the present invention.

FIG. 11 shows a structure for supporting a sign board according to another embodiment of the present invention. This embodiment is different from the first embodiment of the present invention in that a sign board 10 is directly installed on a post clamp 10 by one connecting holder 90 without the hanger and the connectors.

The connecting holder 90 is provided at its one end with a coupling bulge 91, which is slidably fitted into a coupling groove 14*b* formed on a pillar 14 of a post clamp 10, and is provided at the other end with a pair of ribs 92 defining a channel therebetween. The sign board 100 is fitted into the channel defined between the pair of ribs 92, and joined thereto by bolts 93 and nuts 93*a*.

According to this embodiment, a configuration of the structure for supporting a sign board is considerably simplified, the sign board 100 is easily installed on the post "P", and a production cost is reduced due to reduction of the number of associated components.

Figure 12A:
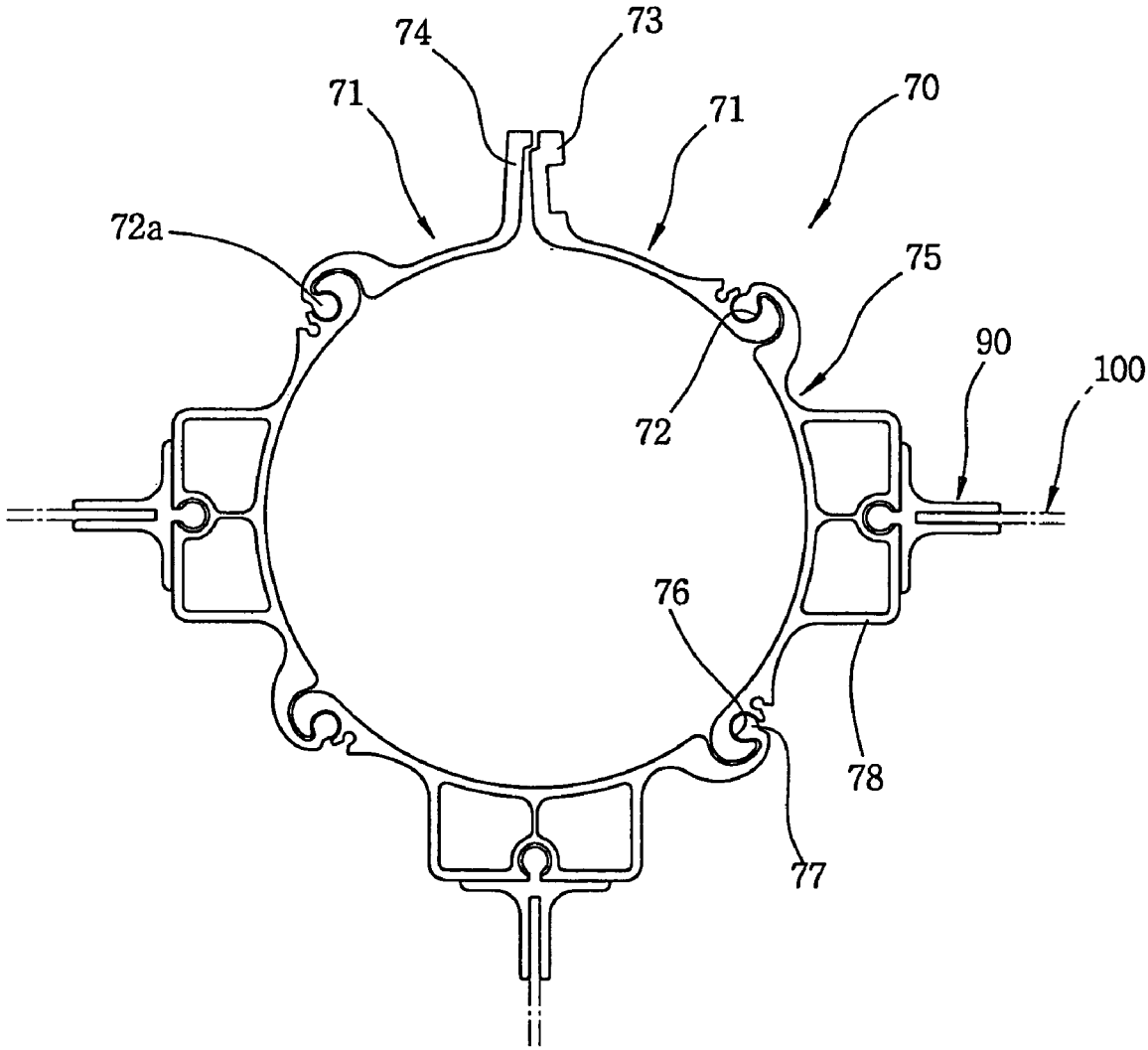
FIGS. 12*a* and 12*b* are a plan cross-sectional views showing further embodiments of a post clamp of the structure according to the present invention shown in FIG. 11.

FIG. 12*a* shows another embodiment of a post clamp according to the present invention. Like the previous embodiment, the post clamp 70 according to this embodiment includes a pair of third clamping bands 71, one of which is provided at its one end with a hinge groove 72 and is provided at its other end with a flange 73, and the other of which is provided at its one end with a hinge bulge 72*a* and is provided at its other end with a flange 74, and a plurality of fourth arched clamping bands 75, each of which is provided at its opposite ends with a hinge groove 76 and a hinge bulge 77 so that the clamping band 75 is hingedly coupled to the third clamping band 71 or the adjacent clamping band 75, and each of which is provided at its outer surface with a pillar 78.

Figure 12B:
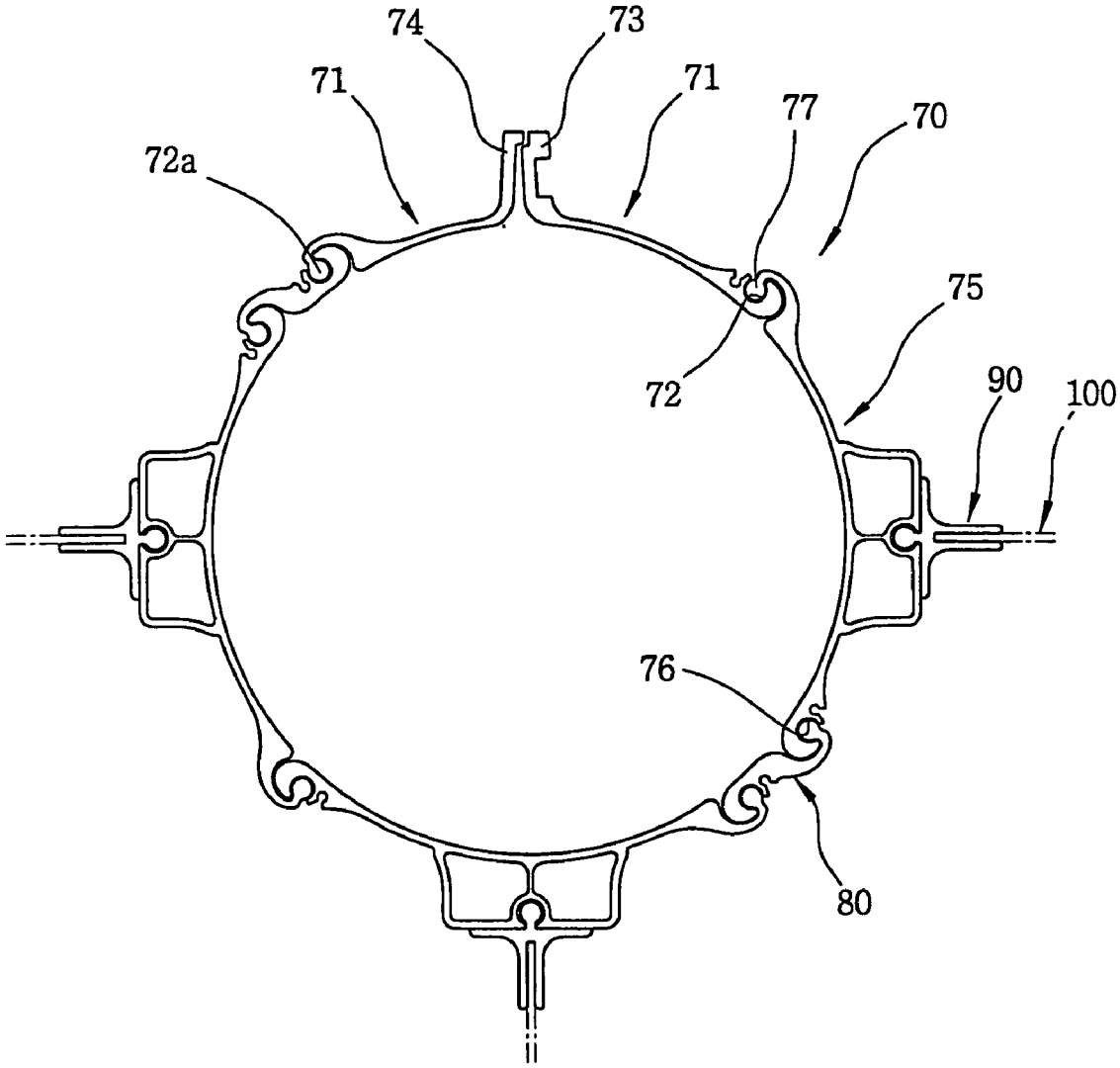

The post clamp 70 may further include auxiliary clamping bands 80, each of which is provided at its opposite ends with a hinge groove 81 and a hinge bulge 82 and has a proper width, as shown in FIG. 12*b*. In this case, the sign board 100 can be conveniently installed on the post "P", regardless of a diameter of the post "P".

As described above, the present invention provides a structure for supporting a sign board, which allows the sign board to be easily installed on a post by a simple operation of placing a post clamp on the post and joining the free ends of the post clamp each other by bolts and nuts. According to the present invention, since associated components of the structure are manufactured from nonferrous metal excellent in corrosion resistance, it is possible to prevent rusting and corrosion of the components, ensure favorable appearance of the structure, and extend a service life of the structure.

Furthermore, since the structure can selectively adopt auxiliary clamping bands according to a diameter of a post, a sign board can be easily installed on the post. Since one post clamp can accommodate a plurality of sign boards if necessary, an installation cost can be reduced.

In addition, since a sign board is suspended from a hanger by hinge holders of connectors passing through an upper end of the sign board, a functional area of the sign board is maximized, thereby improving effectiveness of the sign board.

Accordingly, the present invention has advantages in that working efficiency at a construction site is improved, and extension of a service life of the structure and beautification of a road environment are achieved.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An apparatus for supporting a sign board, comprising:

a post clamp including at least a first arched clamping band and second arched clamping band that are hingedly coupled to each other at their adjacent end portions and joined to each other by at least one fastening element at their free ends to be assembled around a periphery of a post, at least one of said first arched clamping band and said second arched clamping band being provided at its outer surface with a pillar protruding therefrom that includes a groove on a front surface thereof; and a connecting holder with a coupling bulge adapted to be fitted into the groove of the pillar and a channel for receiving the sign board.

2. The apparatus of claim 1, wherein the first arched clamping band and the second arched clamping band include a hinge groove and a hinge bulge at a first end and a flange at a second end such that the hinge grooves and the hinge bulges may be operably interconnected to each other.

3. The apparatus of claim 2, wherein the post clamp further includes at least one auxiliary clamping band coupled between the first clamping band and the second clamping band, the auxiliary clamping band being provided at opposite ends thereof with a hinge groove and a hinge bulge corresponding to each other, and having a circumference smaller than that of any of the first clamping band and the second clamping band, whereby the auxiliary clamping band is selectively coupled between the first and the second clamping bands according to the size of the post.

4. The apparatus of claim 2, wherein the first and the second arched clamping bands are provided adjacent to the hinge groove, with at least one retaining screw that is embedded into the hinge groove to prevent the hinge bulge from being separated from the hinge groove.

5. The apparatus of claim 1, wherein the at least one fastening element is a nut and bolt.

6. The apparatus of claim 1, wherein the post clamp and the connecting holder are made of nonferrous metal.

7. The apparatus of claim 6, wherein the nonferrous metal is aluminum.

8. An apparatus for supporting a sign board, comprising:

a post clamp including at least a first arched clamping band and second arched clamping band each hingedly interconnected to at least one third arched clamping band, the first and second arched clamping bands joined to each other by a fastening element at their free ends to be assembled around a periphery of a post, the at least third arched clamping band being provided at its outer surface with a pillar protruding therefrom that includes a groove on a front surface thereof; and a connecting holder with a coupling bulge adapted to be fitted into the groove of the pillar and a channel for receiving the sign board.

9. The apparatus of claim 8, wherein the first arched clamping band and the second arched clamping band include a hinge groove and a hinge bulge at a first end and a flange at a second end such that the hinge grooves and the hinge bulges may be joined to a hinge bulge or hinge groove on the ends of the at least one third arched clamping band.

10. The apparatus of claim 9, wherein the post clamp further includes at least one auxiliary clamping band coupled between the first arched clamping band and the at least one third arched clamping band, said at least one auxiliary clamping band is provided at its opposite ends with a hinge groove and a hinge bulge corresponding to each other and has a circumference smaller than that of any of the first, second, and at least one third arched clamping bands, whereby the at least one auxiliary clamping band is selectively coupled to the post clamp according to a size of the post.

11. The apparatus of claim 10, wherein the at least one auxiliary clamping band is provided at both ends adjacent to the hinge groove, with at least one retaining screw that is embedded into the hinge groove to prevent the adjoining hinge bulge from being separated from the hinge groove.

12. The apparatus of claim 9, further comprising a fourth claiming band, similar to the at least one third clamping band, and at least one auxiliary clamping band coupled between the at least one third clamping band and the fourth clamping band, said at least one auxiliary clamping band is provided at its opposite ends with a hinge groove and a hinge bulge corresponding to each other and has a circumference smaller than that of any of the first, second, at least one third and fourth arched clamping bands, whereby the at least one auxiliary clamping band is selectively coupled to the post clamp according to a size of the post.

13. The apparatus of claim 9, wherein the post clamp further includes at least one auxiliary clamping band coupled between the at least one third arched clamping band and the second arched clamping band, said at least one auxiliary clamping band is provided at its opposite ends with a hinge groove and a hinge bulge corresponding to each other and has a circumference smaller than that of any of the first, second, and at least one third arched clamping bands, whereby the at least one auxiliary clamping band is selectively coupled to the post clamp according to a size of the post.

14. The apparatus of claim 8, wherein the post clamp and the connecting holder are made of nonferrous metal.

15. The apparatus of claim 14, wherein the nonferrous metal is aluminum.

16. The apparatus of claim 8, wherein the first arched clamping band and the second arched clamping band is provided at its outer surface with a pillar protruding therefrom that includes a groove on a front surface thereof.

* * * * *